United States Patent [19]

Johnson

[11] Patent Number: 4,974,582

[45] Date of Patent: Dec. 4, 1990

[54] ACUPRESSURE PAD

[76] Inventor: Gary C. Johnson, P.O. Box 213, Nellysford, Va. 22958

[21] Appl. No.: 425,105

[22] Filed: Oct. 20, 1989

[51] Int. Cl.[5] ..... A61H 7/00

[52] U.S. Cl. ..... 128/60; 128/67; 128/69

[58] Field of Search ..... 128/60, 25 R, 67, 69; 5/431

[56] References Cited

U.S. PATENT DOCUMENTS

| | | | |
|---|---|---|---|
| 2,777,440 | 1/1957 | Baker | 128/60 X |
| 3,886,939 | 6/1975 | Boxer | 128/60 X |
| 4,017,076 | 4/1977 | Bai | 273/346 |
| 4,022,189 | 5/1977 | Boxer | 128/60 X |
| 4,029,316 | 6/1977 | Clarke | 273/346 X |
| 4,233,966 | 11/1980 | Takahashi | 128/60 X |
| 4,699,127 | 10/1987 | Schley | 128/65 X |

*Primary Examiner*—Edgar S. Burr
*Assistant Examiner*—Moshe I. Cohen
*Attorney, Agent, or Firm*—Peter L. Klempay

[57] ABSTRACT

A pad on which a user lies to apply pressure to selected points on the body consists of two fabric panels and a number of balls having fabric engaging tabs at diametrically opposed points. The balls are placed on one of the panels at the points of desired pressure application and then covered by the second panel. The two panels may be connected together and carry grid markings to assist in positioning of the balls.

17 Claims, 2 Drawing Sheets

ACUPRESSURE PAD

BACKGROUND OF THE INVENTION

The present invention pertains to pads for use in acupressure therapy and, more particularly, to such pads which allow the user to easily select the number and locations of the points to which pressure is to be applied.

Acupressure therapy can be defined as the application of pressure to localized areas of the human body for the relief of pain and/or tension. Takahashi, 1980, U.S. Pat. No. 4,233,966, discloses a device for use in acupressure therapy, the device consisting of a wood or plastic panel having a pattern of holes in its upper surface and a number of spherical-headed knobs. In using the device, the individual places knobs in selected ones of the holes and then lays on the panel so that the knobs press against the desired locations on the individual's back, for example. The placement of the knobs, and the location of the points of pressure application, is limited, however, by the predetermined pattern of holes.

It is a primary object of the present invention to provide a device for acupressure therapy in the form of a pad on which pressure applying points may be selected without restriction.

It is also an object of the present invention to provide such an acupressure pad which forms a compact unit for carrying and storage.

SUMMARY OF THE INVENTION

The above and other objects of the invention which will become apparent hereinafter are achieved by the provision of an acupressure pad which includes, in the preferred embodiment, an elongate fabric panel marked on one face with a regular grid pattern, the face having a pile surface; and a plurality of small diameter balls each of which has two regions of hook-type fastening material, such as that identified by the trademark VELCRO, at diametrically opposite points on the surface thereof. The pad is used by laying the panel on a flat surface with the grid-marked face upward, placing one or more of the balls at locations along one half the length of the panel corresponding to the points of desired pressure application on the user's body, the grid markings assisting in locating the balls and the hook-type fastening material holding the balls in place. When the balls are in the desired locations, the panel is folded on its transverse centerline so that the second half of the panel overlies the first with the balls sandwiched therebetween, the second hook-like fasterner of the balls serving to hold the second half of the panel in place. The user then lays on the pad, the body weight being concentrated at the locations of the balls to provide the desired pressure.

For a more complete understanding of the invention and the objects and advantages thereof, reference should be had to the accompanying drawing and the following detailed description wherein a preferred embodiment of the invention is illustrated and described.

DESCRIPTION OF THE PREFERRED EMBODIMENT

Figure 1:
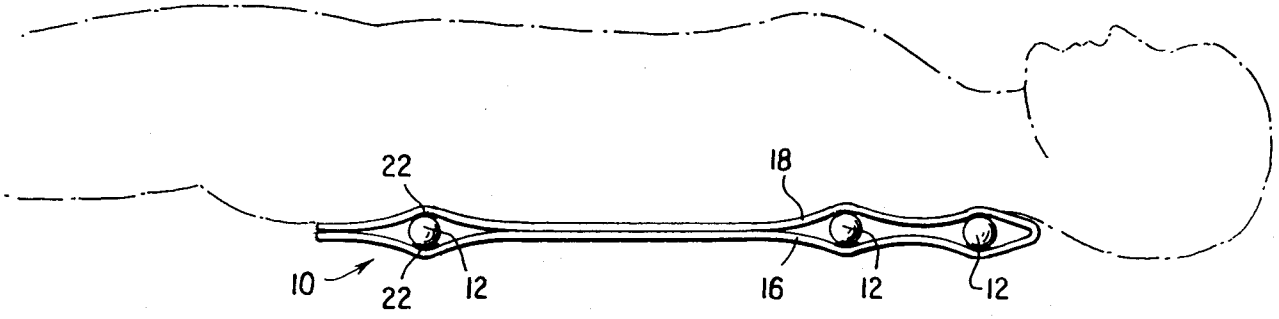
FIG. 1 is a side elevational view of the acupressure pad of the present invention showing the manner of its use.
Figure 2:
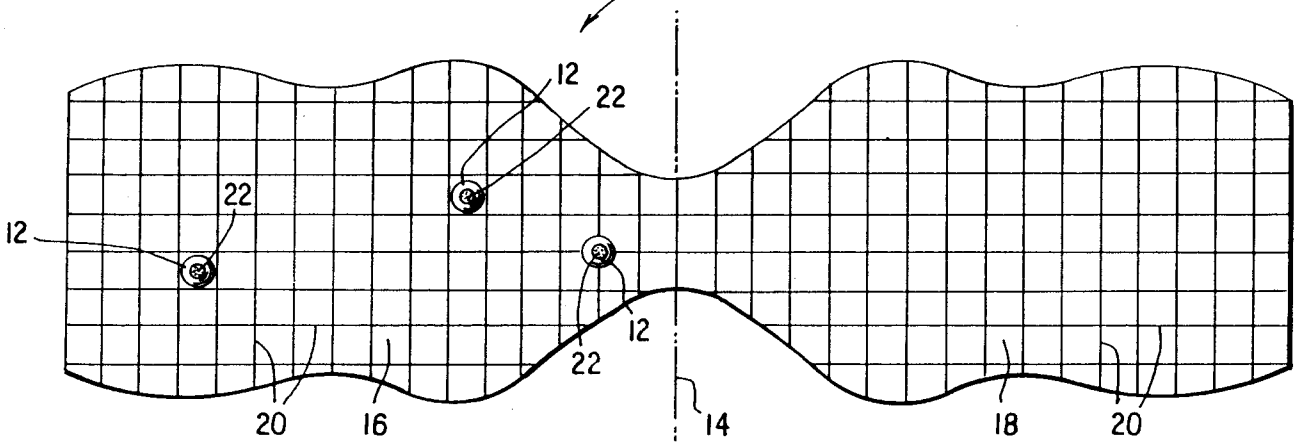
FIG. 2 is a plan view of the fabric mat.
Figure 3:
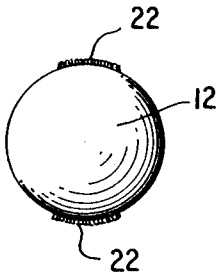
FIG. 3 is a side elevational view of one of the balls, on an enlarged scale.

The acupressure pad consists of a mat 10 on which the user lies and a number of spherical balls 12 which are placed at the points at which pressure application is desired. The mat, which may be an elongate piece of indoor/outdoor carpet, is, preferrably, symmetric about the transverse centerline with each panel 16, 18 being of such length and width as to underlie the portion of the user's body to which it is desired to apply pressure. While the panels may be of any desired shape, the configuration shown in FIG. 2, in which the panels approximate the silhoutte of the human torso is preferred as this configuration assists the user in positioning the balls at the desired locations. To further assist in positioning the balls, the pile face of the mat may be marked with a grid pattern 20.

The balls 12 are, preferrably, hollow plastic ones and may range in diameter between 20 mm. and 50 mm. Each ball has, at two diametrically opposed points, tabs 22 of hook-type fastening material, such as that identified by the trademark VELCRO. The tabs are affixed by a suitable adhesive, for example.

Use of the acupressure pad involves placing the mat 10 on a suitable support surface with the grid-marked pile face upward, locating one or more of the balls 12 at the point or points on the panel 16 which correspond to the desired points of pressure application to the user's body, the balls being held in place by engagement of one of the tabs 22 with the pile face of the mat, and folding the mat about the centerline 14 to position the other panel 18 over the first panel. The second tab of each ball grips the pile face of the second panel to hold the panels in place. The user then lies atop the mat, the body weight being concentrated at the locations of the balls to provide the desired pressure.

Figure 4:
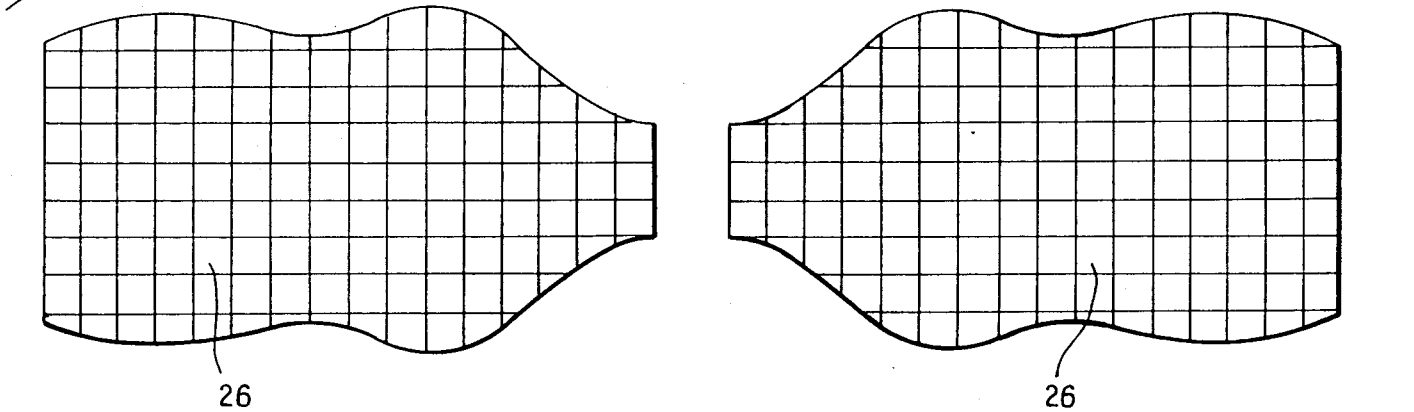
FIG. 4 is a plan view of a second embodiment of the fabric mat.

In an alternate embodiment of the mat, as shown in FIG. 4, the panels are separate fabric pieces 24, 26. The two pieces or panels are, preferrably, congruent and are provided with grid markings to facilitate positioning of the balls at the desired points. The manner of using this embodiment is similar to that described above, one or more balls 12 being placed at the desired locations on the first panel 24 with the tab 22 engaging the fabric and the second panel 26 being superimposed on the first panel and the balls to form the acupressure pad.

While a preferred embodiment of the invention has been illustrated and described, it will be understood that changes and additions may be had therein and thereto without departing from the spirit of the invention. Reference should, accordingly, be had to the appended claims in determining the true scope of the invention.

I claim:

1. An acupressure pad for applying pressure to selected points on an area of the human body comprising:

a fabric mat of a width at least equal to the width of the area of pressure application and of a length at least equal to twice the length of the area, said mat being foldable about the transverse centerline thereof into first and second panels; and at least one ball having two tabs of fabric engaging material located at diametrically opposed points on said ball;

the arrangement being such that said ball is positioned on said first panel at a point coresponding to a point of desired pressure application and retained in position by engagement of one of said tabs with said first panel, said second panel subsequently being folded over said first panel and into engagement with the other of said tabs, thereby forming a pad on which the user may lie.

2. The acupressure pad of claim 1 further including a grid pattern marked on said mat to assist in positioning of said ball.

3. The acupressure pad of claim 2 wherein the configuration of said panels approximates the silhoutte of the human torso.

4. The acupressure pad of claim 3 wherein the diameter of said balls is in the range of 20 mm. to 50 mm.

5. The acupressure pad of claim 2 wherein the diameter of said balls is in the range of 20 mm. to 50 mm.

6. The acupressure pad of claim 1 wherein the configuration of said panels approximates the silhoutte of the human torso.

7. The acupressure pad of claim 6 wherein the diameter of said balls is in the range of 20 mm. to 50 mm.

8. The acupressure pad of claim 1 wherein the diameter of said balls is in the range of 20 mm. to 50 mm.

9. An acupressure pad for applying pressure to selected points on an area of the human body comprising:

a pair of fabric panels, the width and length of which are at least equal to the width and length of the area of pressure application; and at least one ball having two tabs of fabric engaging material located at diametrically opposed points on said ball;

the arrangement being such that said ball is positioned on said first panel at a point corresponding to a point of desired pressure application and retained in position by engagement of one of said tabs with said first panel and said second panel is superimposed over said first panel and said ball and into engagement with the other of said tabs, thereby forming a pad on which the user may lie.

10. The acupressure pad of claim 9 further including a grid pattern marked on said first panel to assist in positioning of said ball.

11. The acupressure pad of claim 10 wherein the configuration of said panels approximates the silhoutte of the human torso.

12. The acupressure pad of claim 11 wherein the diameter of said balls is in the range of 20 mm. to 50 mm.

13. The acupressure pad of claim 10 wherein the diameter of said balls is in the range of 20 mm. to 50 mm.

14. The acupressure pad of claim 9 wherein the configuration of said panels approximates the silhoutte of the human torso.

15. The acupressure pad of claim 14 wherein the diameter of said balls is in the range of 20 mm. to 50 mm.

16. The acupressure pad of claim 9 wherein the diameter of said balls is in the range of 20 mm. to 50 mm.

17. The acupressure pad of claim 9 wherein said panels are connected end-to-end, forming a single fabric mat.

* * * * *